US007783176B2

(12) United States Patent
Scott et al.

(10) Patent No.: US 7,783,176 B2
(45) Date of Patent: Aug. 24, 2010

(54) HEATERS FOR LIQUID HEATING VESSELS

(75) Inventors: Michael James Scott, Onchan (IM); Iain Fenna, Peel (IM)

(73) Assignee: Strix Limited, Ronaldsway (GB)

( * ) Notice: Subject to any disclaimer, the term of this patent is extended or adjusted under 35 U.S.C. 154(b) by 175 days.

(21) Appl. No.: 11/770,204

(22) Filed: Jun. 28, 2007

(65) Prior Publication Data

US 2009/0003809 A1 Jan. 1, 2009

(51) Int. Cl.
*F24C 1/00* (2006.01)

(52) U.S. Cl. ..... 392/309; 392/441; 219/443.1; 219/446.1

(58) Field of Classification Search ..... None
See application file for complete search history.

(56) References Cited

U.S. PATENT DOCUMENTS

| | | | | | |
|---|---|---|---|---|---|
| 1,705,702 | A | * | 3/1929 | Backer | 219/468.1 |
| 2,255,499 | A | * | 9/1941 | Blaha | 219/468.2 |
| 3,526,863 | A | | 9/1970 | Vogelsang | |
| 3,622,925 | A | | 11/1971 | Rose | |
| 3,733,568 | A | | 5/1973 | Prouty et al. | |
| 3,789,189 | A | * | 1/1974 | Fischer et al. | 219/467.1 |
| 4,414,466 | A | * | 11/1983 | Fischer et al. | 219/455.11 |
| 4,431,908 | A | * | 2/1984 | Fischer et al. | 219/465.1 |
| 4,707,589 | A | * | 11/1987 | Brooks et al. | 219/458.1 |
| 4,714,822 | A | * | 12/1987 | Braun et al. | 219/448.12 |
| 4,857,709 | A | * | 8/1989 | Janssen et al. | 219/459.1 |
| 4,861,969 | A | * | 8/1989 | Kicherer et al. | 219/451.1 |
| 5,294,779 | A | * | 3/1994 | Miquelot | 219/447.1 |
| 5,422,459 | A | * | 6/1995 | Zhou | 219/465.1 |
| 6,121,586 | A | | 9/2000 | Taylor et al. | 219/438 |
| 6,834,160 | B1 | | 12/2004 | Chen-Lung et al. | 1/18 |

FOREIGN PATENT DOCUMENTS

| | | | |
|---|---|---|---|
| DE | 10131995 | 11/2002 | 27/21 |
| EP | 1233649 | 8/2002 | 1/2 |
| EP | 1762161 | 3/2007 | |
| EP | 1767128 | 3/2007 | |
| GB | 1356502 | 6/1974 | |
| GB | 2135143 | 8/1984 | |
| WO | WO 99/12393 | 3/1999 | |
| WO | WO 01/47399 | 7/2001 | |
| WO | WO 02/00077 | 1/2002 | 37/12 |

* cited by examiner

*Primary Examiner*—Thor S Campbell
(74) *Attorney, Agent, or Firm*—O'Shea Getz P.C.

(57) ABSTRACT

An underfloor heater for a liquid heating vessel comprises a base plate, a heat diffuser portion in good thermal contact with the base plate, a heating element in good thermal contact with the diffuser portion and a sensing region for receiving a thermal sensor. The sensing region is not directly connected to the diffuser portion and is at least partly surrounded by a wall. The sensing region may be provided with a second separate diffuser portion comprising a disc of aluminum brazed to the underside of the base plate.

19 Claims, 4 Drawing Sheets

HEATERS FOR LIQUID HEATING VESSELS

CROSS REFERENCE TO RELATED APPLICATIONS

This application is related to pending U.S. patent application Ser. No. 11/770,290 filed on Jun. 28, 2007.

BACKGROUND OF THE INVENTION

1. Field of the Invention

This invention relates to underfloor heaters which are arranged to form or close an opening in the base of a liquid heating vessel.

2. Background Information

Underfloor heaters for liquid heating vessels are well known and may be divided generally into two categories: sheathed heaters, which have a sheathed resistance element mounted to or formed on the underside of a metal base plate; and thick film heaters which comprise a printed resistance track on the underside of the base plate. In both bases it is conventional to provide an aluminum diffuser plate between the heating element/track and the base plate itself which is usually of stainless steel. Such a diffuser plate serves several functions, an important one of which is to conduct heat from the element to a thermally responsive sensor in order that overheating caused, for example, by operating the heater without any liquid in the vessel, may be sense quickly and action taken to switch off the heater.

In some applications however, it is desirable to use a thermal sensor to measure the temperature of liquid in the vessel through the heated base. This might, for example, be done in order to heat the liquid to or maintain it at a temperature below boiling. An example of a control arrangement which is designed to do just that is the Applicant's U19 series of controls described in EP-A-1233649. In that document there is disclosed the idea of providing apertures in the diffuser plate between the element and the thermal sensor in order at least partially to decouple the thermal sensor from the direct influence of the heating element, thereby allowing it better to follow the temperature of the liquid in the vessel.

The Applicant has realized that whilst this arrangement is indeed effective it cannot give complete isolation of the sensor from the heater since there must always be part of the diffuser plate which connects the location of the sensor to the heating element.

It is an object of the present invention to improve upon or at least provide an alternative to such arrangements and thus when viewed from a first aspect the invention provides an underfloor heater for a liquid heating vessel comprising a base plate, a heat diffuser portion in good thermal contact with the base plate, a heating element in good thermal contact with the diffuser portion and a sensing region for receiving a thermal sensor wherein said sensing region is not directly connected to the diffuser portion and is at least partly surrounded by a wall.

SUMMARY OF THE INVENTION

Thus it will be seen by those skilled in the art that in accordance with the invention the sensing region is thermally isolated from the element since it is not connected to the diffuser portion. The sensing region need not have a diffuser portion or the like so that the thermal sensor is arranged to bear directly on to the base plate. However, it is preferred to provide a second heat diffuser portion between the thermal sensor and the base plate. This could be of any suitable material or construction but is preferably of similar characteristics—such as thickness and/or material—to the main heat diffuser portion. Having a diffuser portion in the sensing region is advantageous since it increases the heat capacity of the sensing region which permits better thermal sensing and provides a mechanical 'filter' of the temperature signal. Additionally where, as is preferred, the heat diffuser portion in at least the sensing region is of aluminum, more intimate mating of the thermal sensor can be achieved since aluminum is softer than stainless steel of which the base plate is typically made.

Simply having a separate 'island' diffuser portion not connected to the main diffuser portion would give rise to significant manufacturing difficulties since the two portions of diffuser material would need to be located and held in place during brazing. However, the wall which partly or fully surrounds the sensing region enables the second diffuser portion in the sensing region to be held in place during brazing.

This concept is novel and inventive in its own right and thus when viewed from a second aspect the invention provides an underfloor heater for a liquid heating vessel comprising a base plate, a main heat diffuser portion in good thermal contact with the base plate, a heating element in good thermal contact with the main diffuser portion and a sensing region for receiving a thermal sensor wherein said sensing region comprises a second, separate diffuser portion and one or more locating means for locating said second diffuser portion.

When viewed from a further aspect the invention provides a method of making an underfloor heater comprising providing a base plate with locating means at least partially surrounding a sensing region thereof and attaching two separate heat diffuser portions to said base plate, one of said portion being provided in the sensing region and located therein by the locating means.

The locating means could comprise a series of discrete formations or projections on the base plate spaced around the periphery of the sensing region but preferably the locating means comprises a continuous wall partly, or more preferably completely, surrounding the sensing region—i.e. in accordance with the first aspect of the invention.

In accordance with any preceding aspect of the invention the wall could itself be attached to the base plate e.g. by soldering, welding or brazing etc, but in particularly preferred embodiments the wall is provided by forming a channel in the upper, liquid facing side of the base plate. This not only allows the heater to be manufactured conveniently and without requiring a separate part, but the Applicant has also appreciated that since the channel will fill with the liquid being heated during use, it will further enhance the thermal isolation of the sensing region from the heating element and the thermal coupling of the sensing region to the liquid.

As mentioned above, in at least some embodiments of the invention the heating element comprises a sheathed resistance element. The sheathed element could be provided on the main diffuser portion so that the latter is sandwiched between the element and the base plate, or alternatively the element could be provided directly on the base plate whilst also being in good thermal contact with the diffuser plate e.g. by means of an edge thereof.

The sensing region may be on any convenient part of the heater and the location may be dictated by design constraints imposed by a corresponding control unit. Preferably however it is located substantially centrally on the base plate. This is beneficial where a sheathed heating element is provided around the periphery of the plate as the center is then one of the parts of the which receive least heat. This further enhances the thermal isolation of the sensing region from the heating element.

The invention extends to an assembly comprising an underfloor heater as described herein and a control arrangement comprising a thermal sensor wherein the thermal sensor is arranged in good thermal contact with the sensing region. The invention also extends to a liquid heating vessel including such an assembly.

DESCRIPTION OF THE DRAWINGS

Certain embodiments of the present invention will now be described, by way of example only, with reference to the accompanying drawings in which.

DETAILED DESCRIPTION OF THE INVENTION

Figure 1:
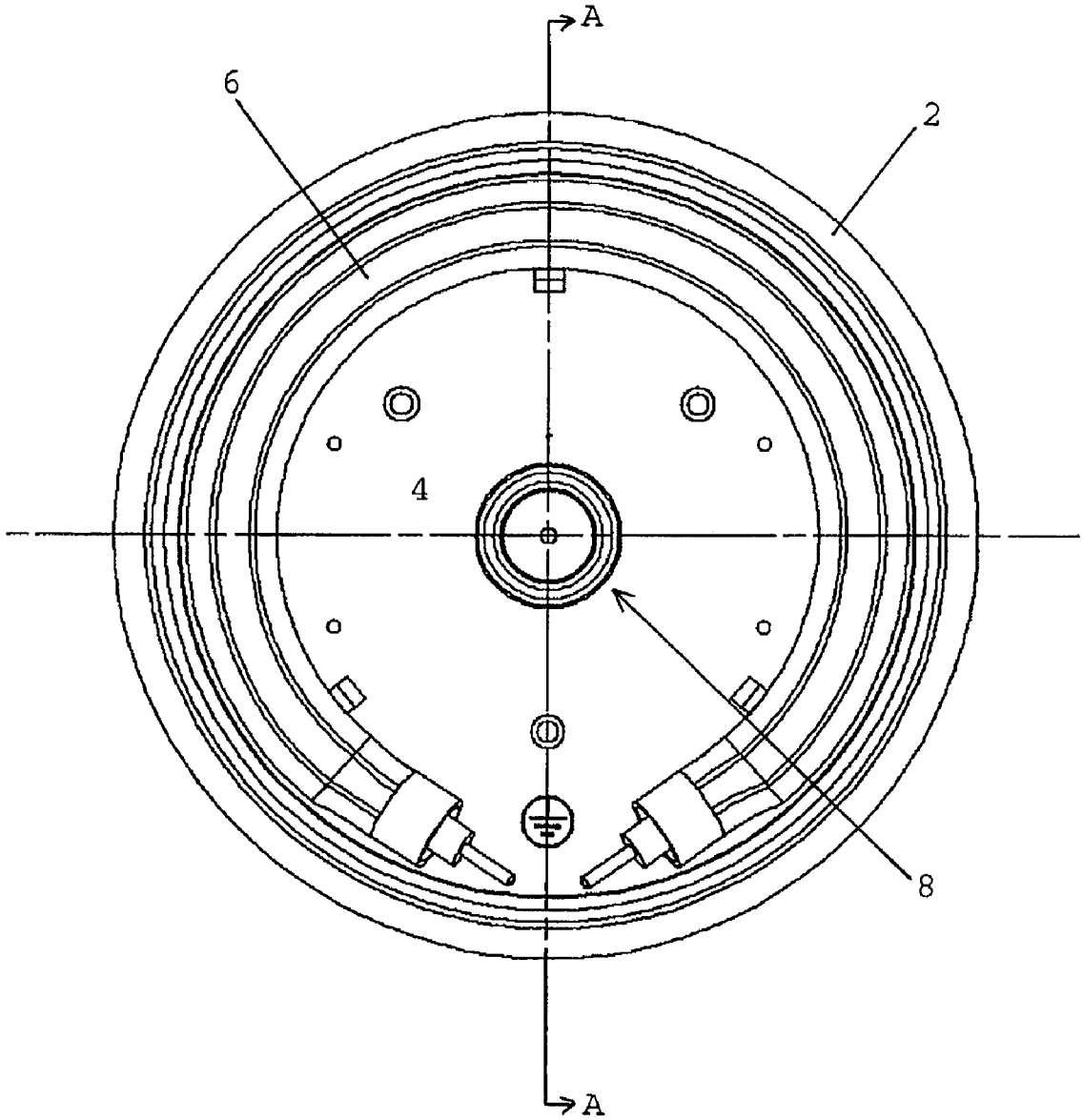
FIG. 1 is a bottom elevation of an underfloor heater in accordance with the present invention.
Figure 2:
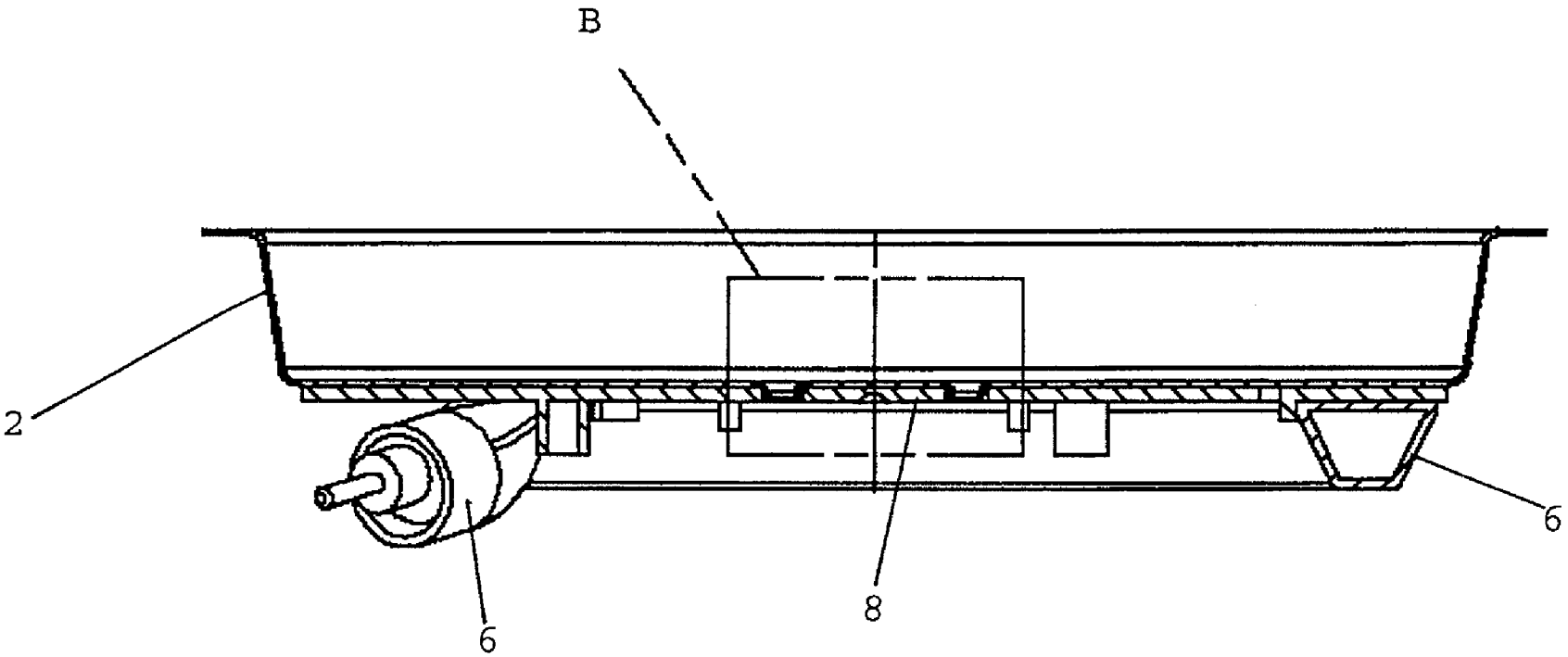
FIG. 2 is a section on line AA of FIG. 1.

FIGS. 1 and 2 show an underfloor heater for closing an opening in or forming the base of a liquid heating vessel. The heater comprises a dish-shaped stainless steel base plate 2. This is shown as having a flat lip at its periphery although equally it could be provided with an upwardly open peripheral channel in accordance with the Applicant's Sure Seal system which is described in further detail in WO 96/18331.

On the underside of the base plate 2 is an aluminum diffuser plate 4. An annular sheathed heating element 6 of well known type is brazed to the diffuser plate 4 at its periphery. This will typically be rated at between 2.2 and 3 kilowatts.

Figure 3:
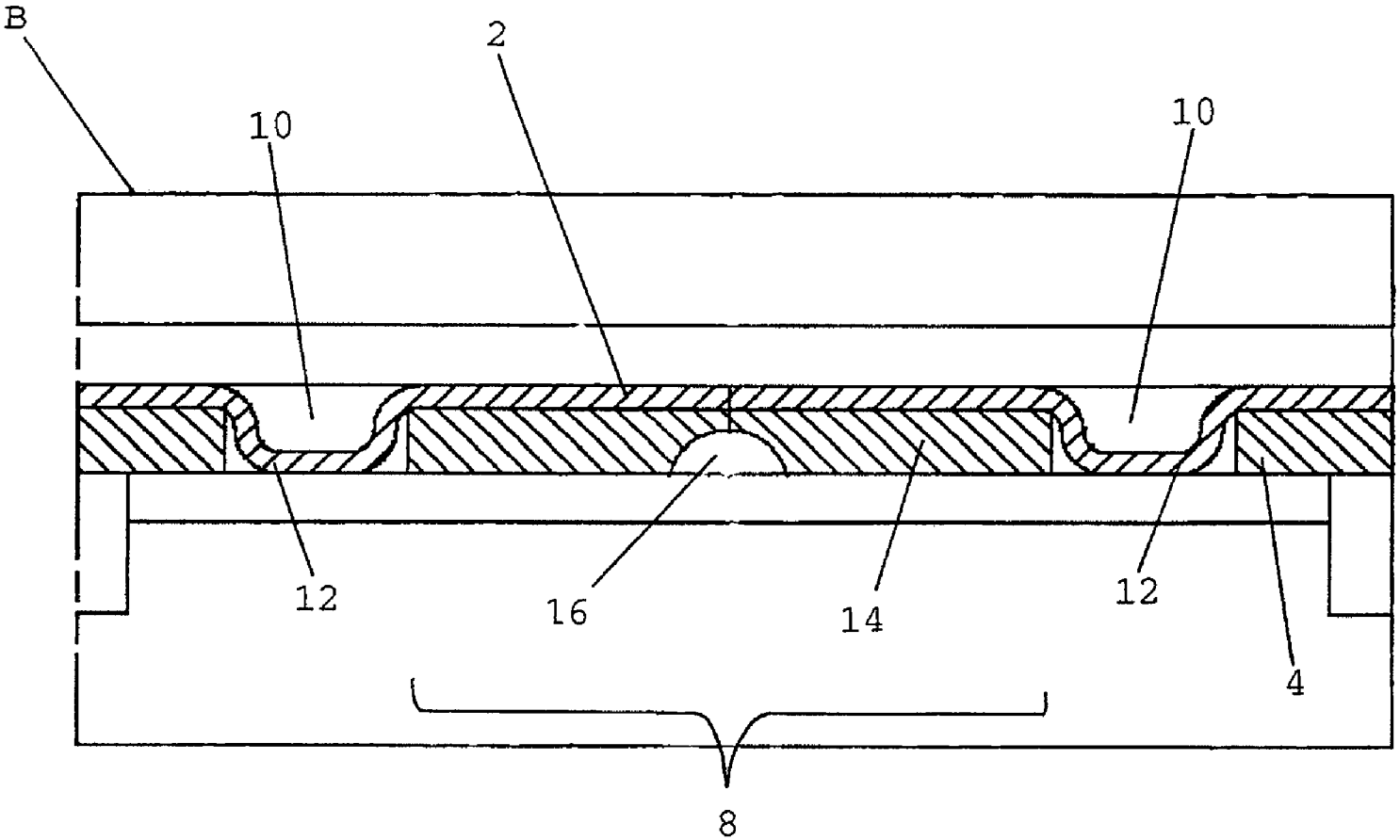
FIG. 3 is an enlarged view of part of the section of FIG. 2 marked B.

At the center of the heater the aluminum diffuser plate 4 has a circular hole inside which is defined a sensing region 8 which will be described in greater detail below with reference to FIG. 3.

Radially inwardly of the hole at the center of the diffuser plate 4, the base plate 2 is formed with an annular channel 10 on its wet face which forms a corresponding annular wall 12 on the underside of the plate. The annular wall 12 defines inside it the circular sensing region 8 which is provided with a second separate diffuser portion comprising a disc of aluminum 14 of the same thickness as the main diffuser plate 4 brazed to the underside of the base plate 2.

In the center of the aluminum disc 14 is a recess 16 which is shaped to receive a thermal sensor, for example a thermistor.

A control unit (not shown) may be mounted to the underside of the heater so that a thermal sensor, e.g. a thermistor, is received against the recess 16 of the sensing region 8. Of course the thermal sensor need not be part of an integrated control unit but could be a separate component.

In use the vessel is filled with water and the element 6 is energised to heat the water. The temperature of the main diffuser plate 4 will be a function of both the temperature of the element 6 and of the liquid inside the vessel. The degree of influence of the element temperature upon the temperature of the surface of the main diffuser plate 4 will be dependent upon the distance from the element.

However, the temperature of the central diffuser portion 14 in the sensing region, and thus the temperature seen by the thermal sensor, will be predominantly influenced by the temperature of the water in the vessel since there is a relatively short thermal path through the thin stainless steel base plate 2. There is no direct connection between the sensing pad 14 and the main diffuser plate 4 and indeed the water in the channel 10; and the wall 12; both act as thermal barriers. This means that a sensor placed against the recess 16 can accurately measure the temperature of the water and thereby signal the control to stop heating or reduce the power when a predetermined temperature is reached e.g. 80-85° which is considered the ideal temperature for brewing coffee.

Of course there may be other reasons why it would be desirable to measure the temperature of the liquid in the vessel—for example to measure the rate of change thereof accurately to determine the volume, whether the water is approaching boiling etc.

Figure 4:
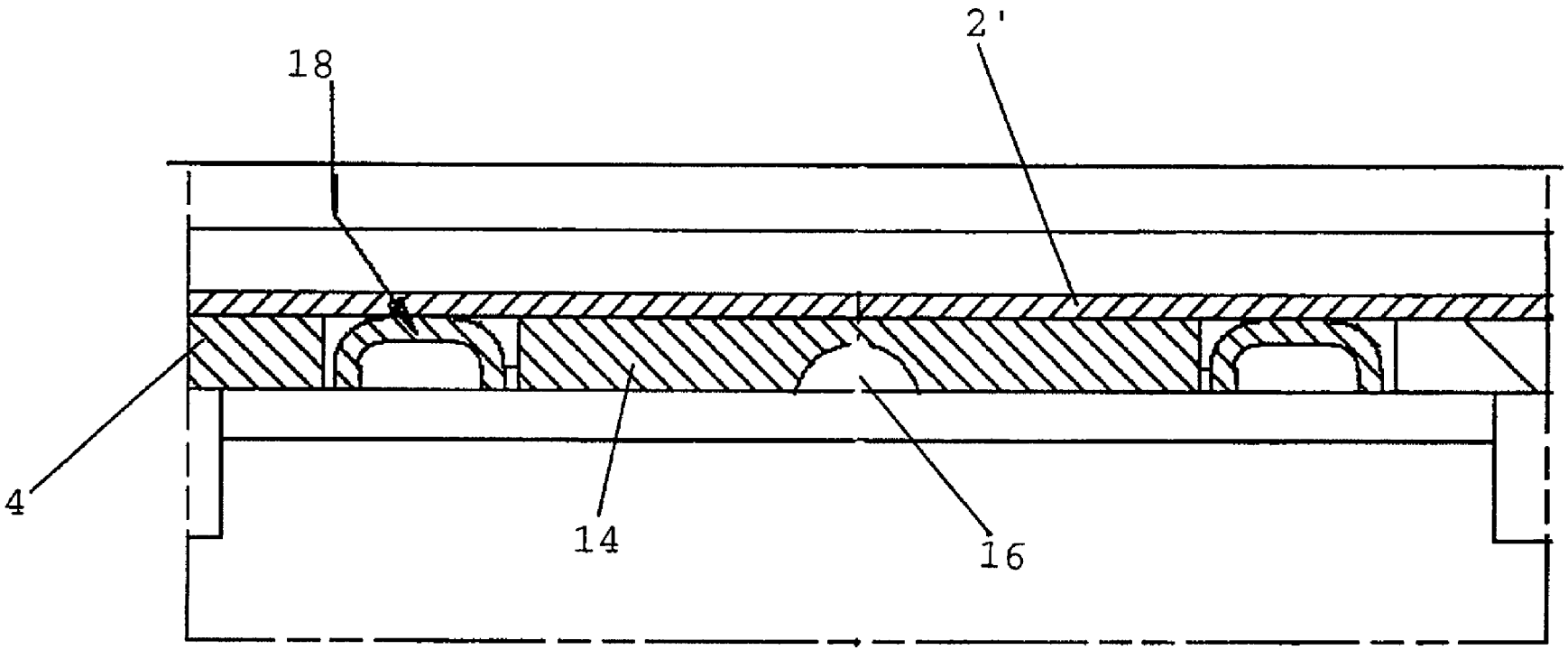
FIG. 4 is a view similar to FIG. 3 of a second embodiment of the invention.

A further embodiment of the invention is shown in FIG. 4. In this embodiment the base plate 2' does not have an annular channel as in the first embodiment but rather the main central region of the base plate is flat. Instead, a separate annular ring member 18 is initially welded to the underside of the base plate 2' and therefore performs the same function as the annular wall 12 in the first embodiment—namely to locate the central aluminum disc 14 during manufacture and also to act as a thermal barrier between the central aluminum disc 14 as the main diffuser plate 4. In all other respects this embodiment is the same as the previous one.

It will be appreciated by those skilled in the art that the embodiments described are merely examples of how the invention may be put into practice and many modifications and variations therefrom are possible within the scope of the invention. For example, it is not applicable only to sheathed element heaters but can also be applied to thick film heaters. Furthermore, it is not essential for a continuous annular wall to be provided instead it may extend only part way around the sensing region; could be a shape other than circular or arcuate; or could comprise a series of discrete features or protrusions rather than a continuous wall.

What is claimed is:

1. An underfloor heater for a liquid heating vessel comprising a base plate, a heat diffuser plate attached to and in good thermal contact with an underside of the base plate, a heating element in good thermal contact with the diffuser plate and a sensing region for receiving a thermal sensor, wherein said sensing region is not directly connected to the diffuser plate and is at least partly surrounded by a wall disposed between the heat diffuser plate and the sensing region, and wherein the wall is formed by, or attached as a separate part to, the base plate.

2. An underfloor heater as claimed in claim 1 wherein a second heat diffuser is provided between the thermal sensor and the base plate.

3. An underfloor heater as claimed in claim 2 wherein said second heat diffuser is of similar characteristics to the main heat diffuser plate.

4. An underfloor heater as claimed in claim 2 wherein said second heat diffuser is of aluminum.

5. An underfloor heater for a liquid heating vessel comprising a base plate, a main heat diffuser plate attached to and in good thermal contact with an underside of the base plate, a heating element in good thermal contact with the main diffuser plate and a sensing region for receiving a thermal sensor wherein said sensing region comprises a second, separate diffuser attached to the underside of the base plate and one or more locating means for locating said second diffuser, the locating means comprising a wall at least partly surrounding the sensing region, and wherein the wall is formed by, or attached as a separate part to, the base plate.

6. An underfloor heater as claimed in claim 5 wherein the wall is continuous.

7. An underfloor heater as claimed in claim 5 wherein the wall is continuous and completely surrounds the sensing region.

8. An underfloor heater as claimed in claim 1 wherein the wall is provided by forming a channel in an upper, liquid facing side of the base plate.

9. An underfloor heater as claimed in claim 1 wherein the heating element comprises a sheathed resistance element.

10. An underfloor heater as claimed in claim 1 wherein the sensing region is located substantially centrally on the base plate.

11. An assembly comprising an underfloor heater as claimed in claim 1 and a control arrangement comprising a thermal sensor wherein the thermal sensor is arranged in good thermal contact with the sensing region.

12. A liquid heating vessel comprising an assembly as claimed in claim 11.

13. A method of making an underfloor heater comprising providing a base plate with locating means comprising a wall at least partially surrounding a sensing region thereof and attaching first and second separate heat diffusers to an underside of said base plate, said first heat diffuser being provided in the sensing region and located therein by the locating means, and wherein the wall is disposed between the first and the second diffusers and is formed by, or attached as a separate part to, the base plate.

14. A method as claimed in claim 13 wherein the wall is continuous.

15. A method as claimed in claim 13 wherein the wall is continuous and completely surrounds the sensing region.

16. A method as claimed in claim 13 further comprising providing the wall by forming a channel in the upper, liquid facing side of the base plate.

17. An underfloor heater as claimed in claim 1 wherein the heat diffuser plate is disposed between the base plate and the heating elements.

18. An underfloor heater as claimed in claim 5 wherein the main heat diffuser plate is disposed between the base plate and the heating element.

19. A method as claimed in claim 13 wherein the second heat diffuser is disposed between the base plate and the heating element.

* * * * *

UNITED STATES PATENT AND TRADEMARK OFFICE

CERTIFICATE OF CORRECTION

PATENT NO. : 7,783,176 B2
APPLICATION NO. : 11/770204
DATED : August 24, 2010
INVENTOR(S) : Scott et al.

It is certified that error appears in the above-identified patent and that said Letters Patent is hereby corrected as shown below:

Column 3, line 65, please insert --8-- after sensing region

Signed and Sealed this
Eighteenth Day of January, 2011

David J. Kappos

David J. Kappos
*Director of the United States Patent and Trademark Office*